United States Patent [19]

Baus

[11] 4,073,035

[45] Feb. 14, 1978

[54] LOWER GUIDE MEMBER FOR ADJACENTLY SUSPENDED, SLIDEABLE PARTITIONS FOR A WET CHAMBER

[76] Inventor: Heinz Georg Baus, Ulmenweg 46, Thun, Switzerland

[21] Appl. No.: 677,797

[22] Filed: Apr. 16, 1976

[30] Foreign Application Priority Data

Apr. 17, 1975 Germany ..... 2516851

[51] Int. Cl.[2] ..... E05D 13/02

[52] U.S. Cl. ..... 16/96 R; 49/408

[58] Field of Search ..... 16/87 R, 87 B, 90, 91, 16/93 R, 94 R, 96 R; 49/405, 407, 408, 409, 410, 411, 413, 504

[56] References Cited

U.S. PATENT DOCUMENTS

| | | | |
|---|---|---|---|
| 2,374,490 | 4/1945 | Lehman | 49/408 X |
| 2,733,487 | 2/1956 | Hauck | 49/408 X |
| 2,761,533 | 9/1956 | Grossman | 49/411 |
| 2,766,857 | 10/1956 | Miller | 49/41 |
| 3,310,914 | 3/1967 | Klavon | 49/411 X |
| 3,350,739 | 11/1967 | Rifkin | 16/90 |
| 3,384,998 | 5/1968 | Abramson | 16/90 X |

*Primary Examiner*—Werner H. Schroeder
*Assistant Examiner*—Moshe I. Cohen
*Attorney, Agent, or Firm*—Herbert L. Lerner

[57] ABSTRACT

Lower guide member for adjacently suspended, slideable partitions for a wet chamber includes a compensating member seatable on the edge of a wet-chamber tub, the compensating member having a hollow profile with a surface decreasing in elevation toward the wet chamber, and a removable guide rail secured to the compensating member, the compensating member being closed at the top thereof and having a cross-piece at the upper side thereof, the guide rail overlapping the cross-piece and includes parallel U-shaped guides, and guide walls respectively disposed between the guides and connected to one another, the guide rail being formed with water outlet openings directed toward the wet chamber.

6 Claims, 3 Drawing Figures

LOWER GUIDE MEMBER FOR ADJACENTLY SUSPENDED, SLIDEABLE PARTITIONS FOR A WET CHAMBER

The invention relates to a lower guide member for adjacently suspended, slideable partitions for wet chambers, especially for bathrooms and/or shower-rooms. More particularly, the invention relates to such lower guide members having a compensating member seatable, as required, on the edge of the bath or shower tub and having a hollow profile with a surface decreasing in elevation toward the wet chamber, water outlet openings associated therewith, and including a removable guide rail.

In a heretofore known guide member of the foregoing general type (German Petty Patent DT-Gbm 7,015,258) the removability of a guide rail with prismatic guides has the objective of assuring the accommodation or matching thereof to differently shaped edges of shower basins or bath tubs. In this heretofore known case, different compensation members are therefore combinable with the guide rail. The respective operation is performed by the craftsman or mechanic during the installation of the partitions.

In the heretofore known case, the guides are disposed essentially adjacent one another in one plane so that one can readily step on the guide rail with bare feet. The guide rail per se is formed with water holes through which sprayed or splashed water finds its way into the compensating member and flows out therefrom over an inclined bottom of the compensating member and through a water outlet opening toward the shower or bath tub.

In the heretofore known device, a hollow space is located below the guide rail, accordingly in the compensating member, in which dirt can accumulate, even if in only very limited quantities. Moreover, the guide rail is inserted from within into the compensating member so that the compensating member, when used, can be expanded or widened.

Guides that are open at the top and have a U-shaped cross-section as such (German Published Prosecuted Application DT-AS 2,314,444), as well as guides that are open at the bottom and have a U-shaped cross section (German Patent DT-PS No. 630,615; brochure of the firm ONI-Metallwarenfabriken Guenter & Co., 4373 Vlotho "Messe Neuheiten" 1975) have become known heretofore.

In the case first mentioned in this paragraph, the spray or splashed water is conducted away through the compensating member. In the case mentioned second in this paragraph, the U-shaped guide is open at the bottom to avoid accumulations of water and dirt and is gripped from behind by the guide members. If different partitions are to be guided adjacent one another, however, the construction of the compensating member and the lower guide members of the partitions will be very complex (the aforementioned brochure of the firm ONI-Metallwarenfabriken Guenter % Co.). In the heretofore known last-mentioned construction, the upper stepped-on surface of the compensating member is also relatively narrow.

It is accordingly an object of the invention to provide a lower guide member for adjacently suspended, slideable partitions for a wet chamber whch may be walked on, is stable and can also be cleaned by the user or by novices or laymen.

With the foregoing and other objects in view, there is provided, in accordance with the invention, a lower guide member for adjacently suspended, slideable partitions for a wet chamber comprising a compensating member seatable on the edge of a wet-chamber-tub, the compensating member having a hollow profile with a surface decreasing in elevation toward the wet chamber, and a removable guide rail secured to the compensating member, the compensating member being closed at the top thereof and having a cross-piece at the upper side thereof, the guide rail overlapping the cross-piece and comprising parallel U-shaped guides, and guide walls respectively disposed between the guides and connected to one another, the guide rail being formed with water outlet openings directed toward the wet chamber.

In the invention of the instant application, the guides are disposed substantially in one plane as in the aforementioned German Petty Patent DT-Gbm No. 7,015,258. However, in accordance with the invention, the guide rail, and not the compensating member, is advantageously used for conducting the spray or splashed water away. The guide rail overlaps or spans the closed compensating member, like a bow or stirrup, and can therefore be removed readily by the user for the purpose of cleaning the same. This cleaning work is advantageously facilitated, in accordance with a further feature of the invention by dividing the removable guide rail transversely to the longitudinal direction of the compensating member. For example, in arranging three slideable partitions adjacent one another, the guide rail can also be divided into three parts so that after sliding all of the three partitions onto one-third of the guide rail, the other parts of the guide rail can be removed.

To conduct the spray or splashed water out of the guide rail, obviously in contrast to the heretofore known compensating members, the guide walls of the U-shaped guides of the invention of the instant application are perforated in vicinity of the bottom of the guide rail, and the bottom plane of the guide rail or the cover surface of the compensating member is inclined in direction toward the wet chamber or both the bottom plane of the guide rail and the cover surface of the compensating member are so inclined.

In accordance with another feature of the invention, the guide rail has no bottom per se, but rather, connecting cross-pieces extending perpendicularly to the guide walls of the U-shaped guides, the connecting cross-pieces being seated on the surface decreasing in elevation toward the wet chamber and which is formed by the cover surface of the compensating member. The connecting cross-pieces thus limit the water outlet openings toward the wet chamber side.

In accordance with an added feature of the invention, the guide walls are integral with the connecting cross-pieces i.e. are welded or cohesive therewith.

In accordance with an alternate feature of the invention, the guide walls are attached or fixed to the connecting cross-pieces.

In accordance with a concomitant feature of the invention, the cross-piece at the upper side of the compensating member is located at one lateral longitudinal side of the latter, the compensating member being formed with a groove in the other lateral longitudinal side thereof located opposite the aforementioned one side thereof, the guide rail being formed with a downwardly extending holder engageable in the groove.

Other features which are considered as characteristic for the invention are set forth in the appended claims.

Although the invention is illustrated and described herein as embodied in lower guide member for adjacently suspended, displaceable partitions for wet-rooms, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
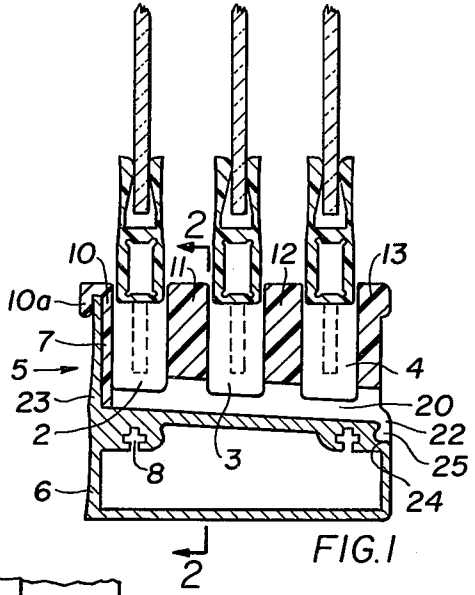
FIG. 1 is a sectional view of a lower guide member for partitions of wet chambers which are suspended displaceably adjacent one another in accordance with the invention of the instant application.

Referring now to the drawing and first, particularly, to FIG. 1 thereof, there is shown a shower partition, for example of tripartite construction, and including three partitions guidable parallel to one another in guides 2 to 4 of a lower guide member 5 constructed in accordance with the invention. The guide member 5 is formed of a compensating member 6 and guide rails 7. In the view of FIG. 1, the wet chamber is located to the right-hand side of the figure.

The compensating member 6 has connector parts 8 for elongating or extending the same or connecting it to other profiled frame parts or to the non-illustrated wall of the wet chamber.

The guide rail 7 has guide walls 10, 11, 12, 13 . . . , and connecting bars 20 extending perpendicularly thereto. The guide walls 10 to 13 are located above the connecting bars 20. The guide rails 7 can be provided with a base. The guidance of water to the wet chamber can, however, also be taken over by channels defined by the connecting bars 20 together with the cover surface 21 of the compensating member 6. If the guide rails 7 have a base or if the base region has been left open, the base plane of the guide rail 7 and/or the cover surface 21 of the compensating member 6 are inclined downwardly toward the wet chamber.

The compensating member 6, at one of the elongated sides thereof, has a wall 23 which is overlapped collar-like by a projection 10*a* from the guide wall 10. At the other elongated side of the compensating member 6, a groove 24 is formed wherein a holder 25 extending downwardly from the guide rail 7 engages. The guide rail 7 is advantageously formed of synthetic material. Accordingly, an advantageous or desirable coefficient of friction is produced thereby with the guide parts of the partitions 1. Moreover, cold shock is avoided when the guide rail 7 is stepped on. An aluminum profiled member is preferably used as compensating member 6.

Figure 2:
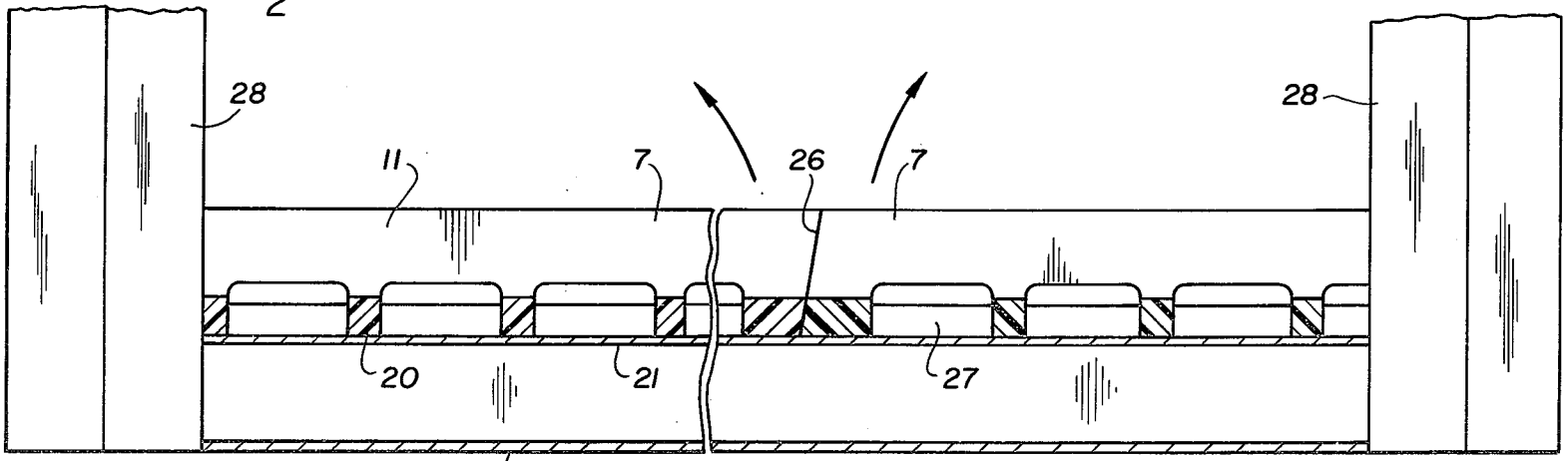
FIG. 2 is a longitudinal sectional view of FIG. 1 taken along the line 2—2 in the direction of the arrows.

In FIG. 2, the arrows indicate that the guide rail 7 can be removed in parts or sections, note the dividing lines 26. FIG. 2 is a sectional view as seen from the wet-chamber side toward the guide wall 11. Flow channels 27, which merge into the outlet openings 22 (FIG. 1), are clearly noted between the connecting bars 20, and a diaphragm or screen molding 28 of lateral profiled frame parts are further indicated.

Figure 3:
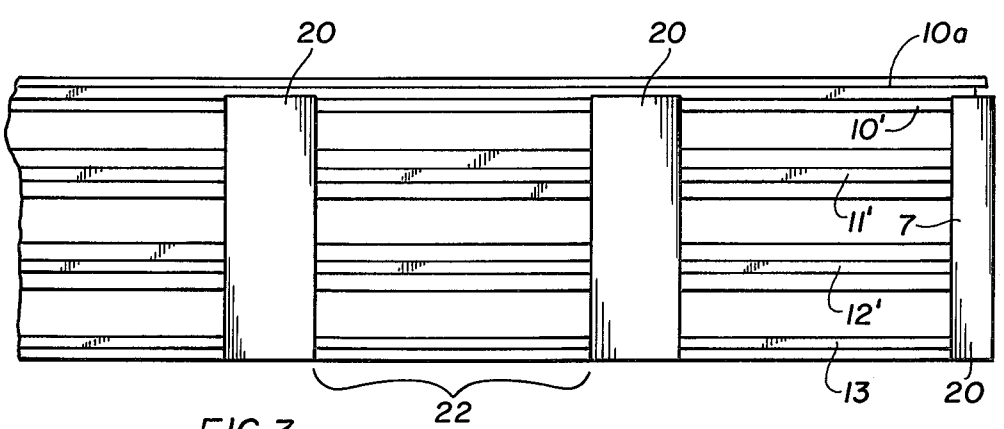
FIG. 3 is an enlarged fragmentary bottom plan view of a guide rail forming part of the guide member of FIGS. 1 and 2.

A modified construction of the guide rail 7 of FIGS. 1 and 2 is shown in a fragmentary bottom plan view in FIG. 3. In the embodiment of FIG. 3, the guide walls 11' and 12' are of T-shaped construction, although the guide wall 13 remains L-shaped, and the guide wall 10 remains provided with the collar-like projection 10*a* as in FIG. 1. The perpendicular beams, respectively, of the guide walls 10, 11', 12' and 13 cohere with the connecting bars 20 or are welded thereto, and, in fact may be integral therewith.

There are claimed:

1. Lower guide member for adjacently suspended, slideable partitions for a wet chamber comprising a compensating member seatable on the edge of a wet-chamber tub and having a hollow profile, means providing an upper surface for said compensating member decreasing in elevation toward the wet chamber, and a removable elongated guide rail secured to said compensating member, said compensating member being closed at said upper surface and having a lateral longitudinal side with a wall extending along said lateral longitudinal side at said upper surface, said guide rail overlapping said wall and comprising parallel U-shaped guides, guide walls respectively bordering said guides and connected to one another, and connecting bars extending perpendicularly to said U-shaped guides, said connecting bars being disposed on said upper surface, said guide rail being formed with water outlet openings directed toward the wet chamber.

2. Guide member according to claim 1 wherein said guide rail is divided at least once transversely to the longitudinal direction of said compensating member.

3. Guide member according to claim 1 wherein said guide walls are fixed to said connecting bars.

4. Guide member according to claim 1 wherein said guide walls are integral with said connecting bars.

5. Guide member according to claim 1 wherein said compensating member is formed with a groove in another lateral longitudinal side thereof located opposite said first-mentioned lateral longitudinal side, said guide rail being formed with a downwardly extending holder engageable in said groove.

6. Guide member according to claim 1 wherein said means formed with an upper surface is a wall portion of said compensating member.

* * * * *